US006718794B2

(12) United States Patent
Brugerolle et al.

(10) Patent No.: US 6,718,794 B2
(45) Date of Patent: Apr. 13, 2004

(54) METHOD AND APPARATUS FOR GENERATING ENERGY

(75) Inventors: Jean-Renaud Brugerolle, Paris (FR); Francois Fuentes, Le Vesinet (FR)

(73) Assignee: L'Air Liquide Société Anonyme à Directoire et Conseil de Surveillance pour l'Etude et l'Exploitation des Procédés Georges Claude, Paris (FR)

( * ) Notice: Subject to any disclaimer, the term of this patent is extended or adjusted under 35 U.S.C. 154(b) by 0 days.

(21) Appl. No.: 10/239,353

(22) Filed: Sep. 20, 2002

(65) Prior Publication Data

US 2003/0136147 A1 Jul. 24, 2003

(30) Foreign Application Priority Data

Mar. 21, 2000 (FR) ..... 00 03583

(51) Int. Cl.[7] ..... F02C 3/20; F02C 3/04; F02C 7/12; F25J 3/04

(52) U.S. Cl. ..... 62/648; 62/650; 62/652; 60/39.12; 60/648

(58) Field of Search ..... 62/643, 646, 648, 62/650, 652; 60/782, 39.12, 806, 648

(56) References Cited

U.S. PATENT DOCUMENTS

| | | | | | |
|---|---|---|---|---|---|
| 3,269,131 | A | * | 8/1966 | Becker | 62/643 |
| 4,224,045 | A | * | 9/1980 | Olszewski et al. | 62/646 |
| 4,382,366 | A | * | 5/1983 | Gaumer | 62/646 |
| 4,545,787 | A | * | 10/1985 | Hegarty | 60/783 |
| 4,854,954 | A | * | 8/1989 | Erickson | 62/651 |
| 5,406,786 | A | * | 4/1995 | Scharpf et al. | 60/775 |
| 5,421,166 | A | * | 6/1995 | Allam et al. | 62/649 |
| 5,501,078 | A | * | 3/1996 | Paolino | 62/656 |
| 5,839,296 | A | * | 11/1998 | Bonaquist et al. | 62/650 |
| 5,901,547 | A | * | 5/1999 | Smith et al. | 60/773 |
| 6,276,171 | B1 | * | 8/2001 | Brugerolle | 62/646 |
| 6,345,517 | B1 | * | 2/2002 | Jahnke | 62/643 |
| 6,434,925 | B2 | * | 8/2002 | Hannemann et al. | 60/39.12 |
| 6,487,863 | B1 | * | 12/2002 | Chen et al. | 60/782 |

FOREIGN PATENT DOCUMENTS

| | | | |
|---|---|---|---|
| EP | 465193 | * | 1/1992 |
| EP | 924486 | * | 6/1999 |
| EP | 959314 | * | 11/1999 |
| WO | WO-8403934 | * | 10/1984 |

* cited by examiner

*Primary Examiner*—William C. Doerrler
(74) *Attorney, Agent, or Firm*—Linda K. Russell

(57) ABSTRACT

The invention concerns a method for generating energy, which consists in conveying to an air separation apparatus (5) air from a compressor (1) coupled to an expansion machine (3). A nitrogen-enriched gaseous flow (11) containing between 3 and 18% of oxygen is conveyed to a combustion chamber (19) with a combustible flow (17) and the combustion gases (33) are expanded in the expansion machine. Optionally air from an auxiliary compressor (21) can be conveyed to the combustion chamber.

24 Claims, 2 Drawing Sheets

METHOD AND APPARATUS FOR GENERATING ENERGY

The present invention relates to a method and an apparatus for generating energy. In particular, it relates to a method and an apparatus for generating energy in which an air separation unit sends a nitrogen-enriched gas stream upstream of an expansion machine which generates energy by expanding the combustion gases.

It also relates to methods and apparatus for separating air adapted to be integrated into an energy generating method of this type.

Various schemes have been proposed to integrate gas turbines and units for separating air by cryogenic distillation, in particular within the context of IGCCs and units for separating air by cryogenic distillation operating at high pressure.

Typically, as described in U.S. Pat. No. 4,224,045, air is taken from the air compressor of the gas turbine to supply, at least partly, the air separation unit which in return sends nitrogen either into the fuel intended for the combustion chamber or upstream of the expansion machine of the turbine.

In U.S. Pat. No. 4,382,366, which is the closest prior art, all the air compressed in a compressor coupled to a gas turbine is sent to a single column. The combustion chamber is supplied with fuel and impure nitrogen coming from the reversible exchangers of the air separation unit.

EP-A-0465193 describes a method in which the compressor coupled to the expansion machine sends no air to the air separation unit.

One aim of the present invention is to simplify the design of the combustion chamber.

Another aim of the invention is to reduce the production of $NO_x$s by the gas turbine.

According to one objective of the invention, provision is made for a method of generating energy using an energy generation unit comprising the steps of:

i) compressing air in a compressor;

ii) sending at least part of the air compressed in the compressor to an air separation unit in order to produce at least one oxygen-enriched fluid and at least one nitrogen-enriched gas also containing oxygen;

iii) sending fuel and at least part of the nitrogen-enriched gas to a combustion chamber in order to produce combustion gases, the air compressed in the compressor not being sent to the combustion chamber; and iv) expanding the combustion gases in an expansion machine coupled to the compressor in order to recover energy;

characterized in that the nitrogen-enriched gas is compressed to a pressure between 8 and 30 bar before being sent to the combustion chamber.

Thus, since all the air from the compressor of the gas turbine is sent to the air separation unit, the combustion chamber is simplified.

Combustion with the oxygen contained in a gas stream of the nitrogen-enriched air coming from an air separation unit makes it possible to produce very little $NO_x$.

According to other optional aspects of the invention:

the air from the compressor is sent to the air separation unit;

part of the air from the compressor is sent to the air separation unit and the rest of the air compressed in the compressor serves to cool at least one element of the unit other than the combustion chamber;

the air sent to the air separation unit comes from the compressor;

part of the air sent to the air separation unit comes from a makeup compressor or a source of pressurized air;

the air from a makeup compressor is sent to the combustion chamber;

the air from the makeup compressor is mixed with at least part of the nitrogen-enriched gas before being sent to the combustion chamber;

at least part of the oxygen-enriched gas is sent in order to gasify a fuel containing carbon so as to generate a fuel stream;

the only gas sent to the combustion chamber apart from the fuel is the nitrogen-enriched gas;

the nitrogen-enriched gas contains at least 5 mol % and at most 18 mol % of oxygen;

another gas stream containing oxygen other than the fuel and the nitrogen-enriched gas is sent to the combustion chamber;

the other gas stream comprises from 2 to 100 mol % of oxygen;

the nitrogen-enriched gas contains less than 18 mol % of oxygen;

the nitrogen-enriched gas contains less than 5 mol % of oxygen;

the air is compressed by the compressor to between 8 and 20 bar.

According to another objective of the invention, provision is made for an energy generating apparatus comprising:

i) a compressor;

ii) an expansion machine coupled to the compressor;

iii) a combustion chamber;

iv) an air separation unit;

v) means for sending the air from the compressor to the air separation unit;

vi) means for sending a nitrogen-enriched gas containing oxygen from the air separation unit to the combustion chamber and no means for sending air from the compressor to the combustion chamber;

characterized in that it comprises means for compressing the nitrogen-enriched gas before sending it to the combustion chamber.

According to other optional aspects, provision is made for:

a makeup compressor for sending air to the air separation unit;

a gasifier, means for sending an oxygen-enriched gas from the air separation unit to the gasifier and means for sending fuel from the gasifier to the combustion chamber.

According to another objective of the invention, provision is made for a method of separating air in an unit comprising at least three columns in which compressed and purified air is sent to a first column, a nitrogen-enriched stream and an oxygen-enriched liquid are extracted from the first column, the oxygen-enriched stream is sent to a second column, a stream is removed from the head of the second column, at least part of the liquid in the bottom of the second column is sent to a third column and a second oxygen-enriched stream and a second nitrogen-enriched stream are withdrawn from the third column, the third column operating at a lower pressure than the second column and being thermally connected thereto by means of a reboiler/condenser, characterized in that compressed and purified air is sent to at least some trays above the bottom of the first column and a bottom reboiler of the first column is heated by another stream.

According to other optional aspects:

means for sending the liquefied air in the bottom boiler from the first column to the second and/or to the third column;

the first column operates substantially at the same pressure as the second column;

means for compressing the nitrogen-enriched gas before sending it to the combustion chamber.

According to another objective of the invention, provision is made for an air separation apparatus comprising at least three columns, means for sending air to a first column, means for sending an oxygen-enriched stream from the first column to the second column, a reboiler/condenser thermally connecting the head of the second column and the bottom of the third column, means for extracting a stream from the head of the second column, means for sending at least part of the liquid at the bottom of the second column to a third column and means for withdrawing a second oxygen-enriched stream and a second nitrogen-enriched stream from the third column, characterized in that it comprises means for sending compressed and purified air to the first column above at least one theoretical tray thereof, a reboiler at the bottom of the first column and means for sending a heating gas to the bottom reboiler.

According to another optional aspect, provision is made for:

means for withdrawing a stream from the head of the second column.

So as to optimize the operation of the combustion chamber, the oxidizer may be a mixture of waste nitrogen from an ASU (air separation unit) and makeup air so as to control the oxygen content.

The invention will now be described in more detail with reference to FIGS. 1 and 2.

Figure 1:
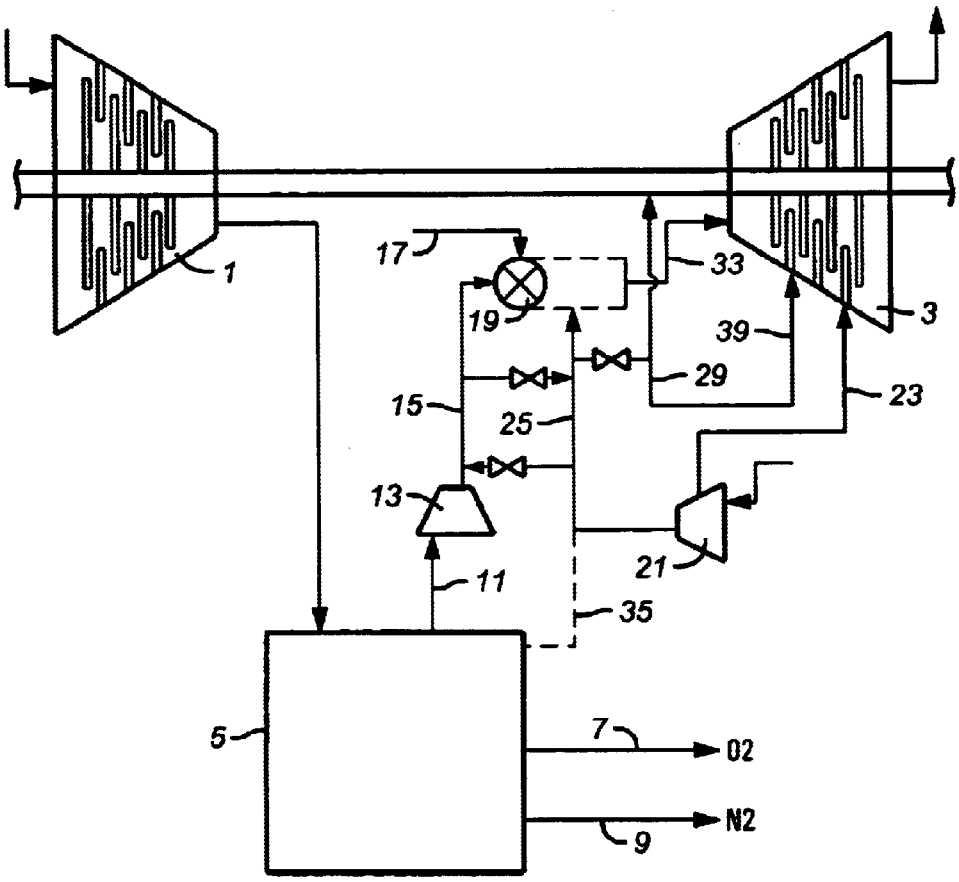
FIG. 1 is a diagram of an apparatus for producing energy according to the invention.

In FIG. 1, a compressor 1 coupled to an expansion machine 3 compresses the air to a pressure of between 8 and 20 bar.

All this air is cooled, purified and sent to an unit 5 for separating air by cryogenic distillation, which produces a gaseous or liquid oxygen stream 7, a gaseous or liquid nitrogen stream 9 and a gaseous waste nitrogen stream 11 containing 91 mol % nitrogen and 9 mol % oxygen at between 3 and 11 bar. The waste nitrogen is reheated to ambient temperature and compressed in a compressor 13 to a pressure of between 8 and 30 bar.

As a variant, the air separation unit may separate the air by permeation or adsorption.

At least part of the compressed gaseous nitrogen 15 is sent, with a stream of natural gas 17, to a combustion chamber 19. The oxygen contained in the gaseous nitrogen acts as a fuel.

Optionally, as shown in dotted lines, an airstream 25 at a pressure between 8 and 30 bar coming from a makeup compressor 21 or another source of pressurized air is sent to the combustion chamber 19.

In this case, since the air contains oxygen, the oxygen content of the waste nitrogen may be lower depending on the amount of air sent to the combustion chamber 19; the nitrogen-enriched stream may comprise only between 2 and 5% oxygen.

Another airstream 23 from this compressor and/or a compressed waste nitrogen stream 27 may cool the interstage of the expansion machine 3 or of the nitrogen compressor 13.

Another airstream 29 from this compressor and/or a compressed waste nitrogen stream 31 may be mixed with the combustion gases 33, all of which is then sent to the expansion machine.

The combustion chamber receives no air from the compressor 1.

Another airstream 37 from this compressor and/or a compressed waste nitrogen stream 39 may cool the rotor 41 of the expansion machine 3 or the walls of the combustion chamber 19.

Part of the air 35 from the makeup compressor 21 may be separated in the air separation unit 5. In this manner, the unit may be supplied with air when the compressor 1 is not operating. Otherwise, this additional airstream from the compressor 21 may make it possible to increase the oxygen production of the unit 5.

The air from the compressor 1 may possibly not be sent to the air separation unit 5 since it is used to cool various elements of the gas turbine. This part of the air may represent about 25% of the compressed air.

The air separation unit may be supplied completely or partially by air coming from a dedicated compressor, at least for startup.

Figure 2:
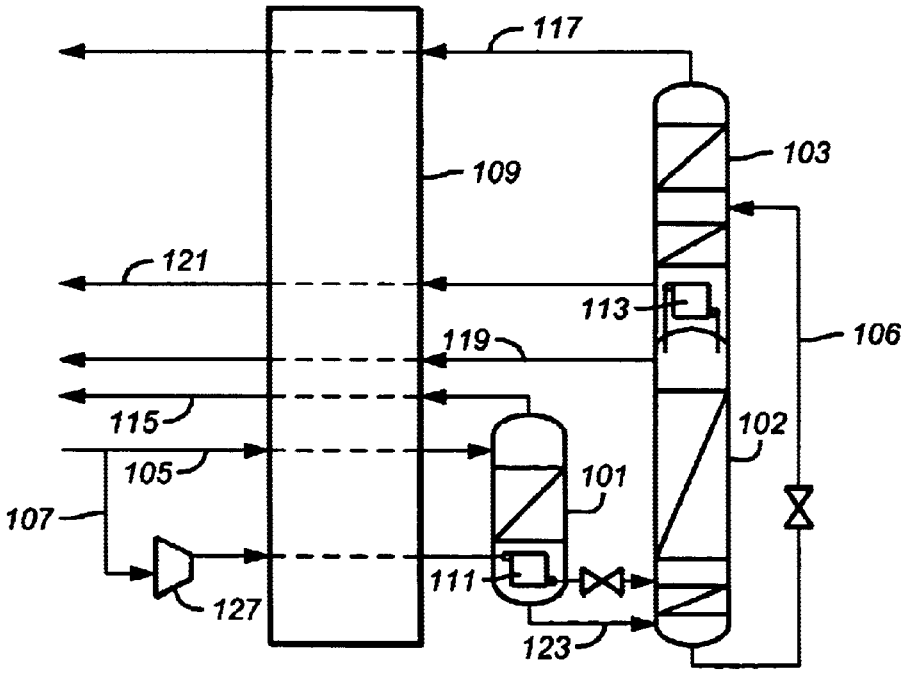
FIG. 2 is a diagram of an ASU according to the invention. This ASU may typically serve in an energy production apparatus like that of FIG. 1.
Figure 3:
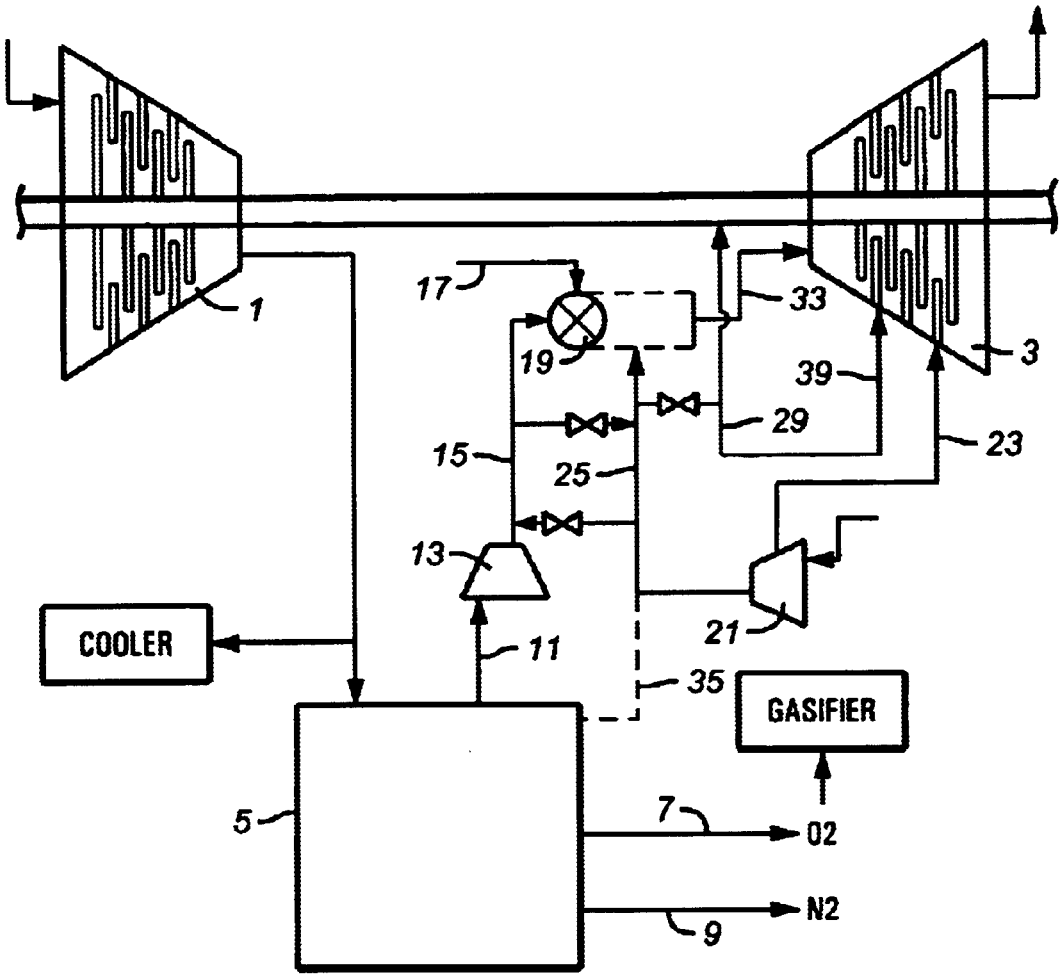

FIG. 2 shows an air separation unit comprising a first column 101 operating between 4 and 30 bar, a second column 102 operating between 4 and 30 bar and a third column 103 operating between 1.3 and 10 bar. This unit could serve as separation unit 5 of FIG. 1. Preferably, the columns 101, 102 operate below 8 bar.

The air from the compressor 1 is purified and divided into two 105, 107. One stream 105 is cooled in the main exchanger 109 and is sent to the head of the first column 101 as the only supply. The other stream 107 is supercharged in the supercharger 127 (which may be a cold supercharger) and cooled in the exchanger 109; next it is sent to the bottom reboiler 111 of the first column 101 where it is condensed at least partially before being sent, after expansion, to the second column. The second column is supplied at the bottom, a few theoretical plates below the partially condensed air, with a liquid stream coming from the bottom of the first column 101. The head gas of the first column is lean air 115, therefore this nitrogen-enriched stream may be intended for the compressor 13 since it is almost at the same pressure as the supply air.

The liquid at the bottom of the second column is expanded and sent to an intermediate level of the third column as the single supply. The bottom of the third column is thermally connected to the head of the second column by means of a vaporizer-condenser 113.

The head gas of the second column 102 is high-pressure nitrogen 119.

Gaseous oxygen 121 is removed from the bottom of the column 103. This stream may possibly be removed in liquid form, pressurized and vaporized in the exchanger 109.

A head gas 117 of the third column is a low-pressure nitrogen-enriched stream and may serve to cool various elements such as the interstages of the turbine, the rotor, etc., rather than the lean air 115 which, itself, is at high pressure.

Obviously, the unit must be kept cold by a means (not illustrated) which may be a Claude turbine sending air to the column 101, 102, a blowing turbine sending the air to the column 103, a waste nitrogen turbine 117 if the column 103 is pressurized or a medium-pressure nitrogen turbine 119.

The second and third columns may be replaced by a triple column.

The diagram of FIG. 2 has been described in the context of an integrated method in which all the air from the compressor of the gas turbine is sent to the ASU, but it is obvious that the diagram can be used in cases where all or part of the air from this compressor is sent to the combustion chamber or even where the ASU is not integrated with another unit.

The compressors 13, 21 and 127 may be coupled to a turbine or turbines of the apparatus, for example, a steam turbine.

What is claimed is:

1. A method of generating energy utilizing an energy generation unit which comprises the steps of:

i) compressing air in a compressor (1);

ii) sending all the air compressed in the compressor (1) to an at least one air separation unit (5) in order to produce at least one oxygen-enriched fluid (7) and at least one nitrogen-enriched gas fluid (9, 11) also containing oxygen;

iii) sending fuel (17) and at least part of the nitrogen-enriched gas (11) to a combustion chamber (19) in order to produce combustion gases (33), the air compressed in the compressor (1) not being sent directly to the combustion chamber; and iv) expanding the combustion gases in an expansion machine (3) coupled to the compressor in order to recover energy;

wherein said nitrogen-enriched gas (11) is compressed to a pressure from about 8 bar to about 30 bar before being sent to the combustion chamber.

2. The method of claim 1, wherein all the air from the compressor (1) is sent to one air separation unit.

3. The method of claim 1, wherein all of the air from the compressor (1) is sent to the air separation unit (5) and to a cooler to cool at least one element of the unit other than the combustion chamber (19).

4. The method of claim 1, wherein at least part of the air sent to the air separation unit (5) comes from the compressor (1).

5. The method according to claim 2, wherein all the air sent to the air separation unit (5) comes from the compressor (1).

6. The method of claim 3, wherein all the air sent to the air separation unit (5) comes from the compressor (1).

7. The method of claim 1, wherein part (35) of the air sent to the air separation unit (5) comes from a makeup compressor (21) or a source of a pressurized air.

8. The method of claim 2, wherein part (35) of the air sent to the air separation unit (5) comes from a makeup compressor (21) or a source of a pressurized air.

9. The method of claim 3, wherein part (35) of the air sent to the air separation unit (5) comes from a makeup compressor (21) or a source of a pressurized air.

10. The method of claim 1, wherein the air from a makeup compressor (21) is sent to the combustion chamber (19).

11. The method of claim 2, wherein the air from a makeup compressor (21) is sent to the combustion chamber (19).

12. The method of claim 3, wherein the air from a makeup compressor (21) is sent to the combustion chamber (19).

13. The method of claim 4, wherein the air from a makeup compressor (21) is sent to the combustion chamber (19).

14. The method of claim 7, wherein at least part of the air from the makeup compressor (21) is mixed with at least part of the nitrogen-enriched gas (15) before being sent to the combustion chamber.

15. The method of claim 1, wherein at least part of the oxygen-enriched gas (7) is sent to a gasifier in order to gasify a fuel containing carbon so as to generate a fuel stream.

16. The method of claim 1, wherein the nitrogen-enriched gas (11, 15) contains at least about 5 mol % and at most about 18 mol % of oxygen or is mixed with air in order to produce a gas containing at least about 5 mol % and at most about 18 mol % of oxygen, this gas then being sent to the combustion chamber (19).

17. The method of claim 1, wherein another gas stream containing oxygen other than the fuel (17) and the nitrogen-enriched gas (11, 15) is sent to the combustion chamber (19).

18. The method of claim 17, wherein the other gas stream comprises from about 2 to about 100 mol % of oxygen.

19. The method of claim 17, wherein the nitrogen-enriched gas (11, 15) contains less than about 18 mol % of oxygen.

20. The method of claim 19, wherein the nitrogen-enriched gas (11, 15) contains less than about 5 mol % of oxygen.

21. The method of claim1, wherein the air is compressed by the compressor (1) is from about 8 to about 20 bar.

22. Energy generating apparatus comprising:

i) a compressor (1)

ii) an expansion machine (3) coupled to the compressor;

iii) a combustion chamber (19);

iv) an air separation unit (5);

v) means for sending the air from the compressor to the air separation unit;

vi) means for sending a nitrogen-enriched gas (11, 15) containing oxygen from the air separation unit to the combustion chamber and no means for sending the compressed air directly from the compressor to the combustion chamber; characterized in that it comprises means (13) for compressing the nitrogen-enriched gas before sending it to the combustion chamber.

23. The apparatus of claim 22, comprising a makeup compressor (2) for sending air to the air separation unit.

24. The apparatus of claim 22, comprising a gasifier, means for sending an oxygen-enriched gas from the air separation unit to the gasifier and means for sending fuel from the gasifier to the combustion chamber (17).

* * * * *

UNITED STATES PATENT AND TRADEMARK OFFICE

CERTIFICATE OF CORRECTION

PATENT NO. : 6,718,794 B2
DATED : April 13, 2004
INVENTOR(S) : Jean-Renaud Brugerolle, François Fuentes It is certified that error appears in the above-identified patent and that said Letters Patent is hereby corrected as shown below:

Column 5,
Line 18, please delete the word "an" at the beginning of the line.
Line 20, please delete the word "gas" after "nitrogen-enriched".

Signed and Sealed this

First Day of June, 2004

JON W. DUDAS
*Acting Director of the United States Patent and Trademark Office*